US010124206B2

(12) United States Patent
Wehrell

(10) Patent No.: US 10,124,206 B2
(45) Date of Patent: Nov. 13, 2018

(54) SYSTEMS AND METHODS FOR OVER SPEED TO RESISTIVE TRAINING

(71) Applicant: Michael A. Wehrell, Tampa, FL (US)

(72) Inventor: Michael A. Wehrell, Tampa, FL (US)

(73) Assignee: VERTIMAX, LLC, Tampa, FL (US)

( * ) Notice: Subject to any disclaimer, the term of this patent is extended or adjusted under 35 U.S.C. 154(b) by 18 days.

(21) Appl. No.: 15/150,287

(22) Filed: May 9, 2016

(65) Prior Publication Data

US 2016/0325131 A1 Nov. 10, 2016

Related U.S. Application Data

(60) Provisional application No. 62/158,993, filed on May 8, 2015.

(51) Int. Cl.
*A63B 24/00* (2006.01)
*A63B 21/00* (2006.01)
(Continued)

(52) U.S. Cl.
CPC ..... *A63B 21/4007* (2015.10); *A63B 21/0442* (2013.01); *A63B 21/0552* (2013.01);
(Continued)

(58) Field of Classification Search
CPC . A63B 24/00; A63B 24/0087; A63B 24/0062; A63B 21/153; A63B 21/00196; A63B 22/0235; A63B 22/02; A63B 23/047; A63B 69/0028; A63B 21/4007; A63B 21/0442; A63B 21/0552; A63B 21/0058;
(Continued)

(56) References Cited

U.S. PATENT DOCUMENTS 4,469,324 A * 9/1984 Dolan ..... A63B 69/0028 104/173.2
4,685,670 A 8/1987 Zinkin
(Continued)

FOREIGN PATENT DOCUMENTS

FR 2982165 A1 5/2013

OTHER PUBLICATIONS

International Searching Authority, International Search Report for PCT/US16/31536 dated Aug. 4, 2016, 1pg.
(Continued)

*Primary Examiner* — Glenn Richman
(74) *Attorney, Agent, or Firm* — Dinsmore & Shohl LLP

(57) ABSTRACT

A system and method for over speed and resistive training is provided. The method may comprise applying an assistive training force to a trainee which assists the self locomotion of the trainee to reach an over speed condition. The method may further comprise applying a resistive training force to the trainee which resists the self-locomotion to the training along the training path, the resistive training force being applied to the trainee while the trainer is in an over speed condition. The forces, either resistive or assistive, may vary linearly. The system may comprise a pair of modules, each module comprising a frame carrying a plurality of pulleys and a resistance cord. Each of the modules is adapted to provide a training vector to a trainee and is positioned on opposite side of training path to provide both resistive and assistive training vectors.

11 Claims, 17 Drawing Sheets

(51) Int. Cl.

| | |
|---|---|
| ***A63B 21/04*** | (2006.01) |
| ***A63B 21/055*** | (2006.01) |
| ***A63B 69/00*** | (2006.01) |
| ***A63B 23/04*** | (2006.01) |
| *A63B 21/005* | (2006.01) |
| *A63B 21/068* | (2006.01) |
| *A63B 21/28* | (2006.01) |

(52) U.S. Cl.
CPC ..... *A63B 21/4009* (2015.10); *A63B 23/0405* (2013.01); *A63B 23/047* (2013.01); *A63B 69/002* (2013.01); *A63B 21/0058* (2013.01); *A63B 21/00065* (2013.01); *A63B 21/068* (2013.01); *A63B 21/153* (2013.01); *A63B 21/154* (2013.01); *A63B 21/28* (2013.01)

(58) Field of Classification Search
CPC ..... A63B 21/068; A63B 21/154; A63B 21/28; A63B 21/00065; A63B 21/4009; A63B 69/002; A63B 23/0405
See application file for complete search history.

(56) References Cited

U.S. PATENT DOCUMENTS

| | | | | |
|---|---|---|---|---|
| 4,830,365 | A | 5/1989 | March | |
| 5,613,926 | A | 3/1997 | Michaelson | |
| 5,658,222 | A | 8/1997 | Brown | |
| 6,042,523 | A | 3/2000 | Graham | |
| 6,220,994 | B1 | 4/2001 | Rich | |
| 6,454,679 | B1 | 9/2002 | Radow | |
| 7,381,163 | B2 * | 6/2008 | Gordon | A63B 22/02 482/69 |
| 7,591,763 | B1 | 9/2009 | Fucci | |
| 7,608,015 | B2 * | 10/2009 | Radow | A63B 22/0235 482/1 |
| 7,997,993 | B1 | 8/2011 | Matthews | |
| 8,147,382 | B2 * | 4/2012 | Eldridge | A63B 21/153 482/1 |
| 8,771,155 | B1 | 7/2014 | Bell | |
| 9,056,218 | B2 | 6/2015 | Zoltak | |
| 9,254,417 | B2 * | 2/2016 | Lawrence | A63B 24/00 |
| 9,795,819 | B2 * | 10/2017 | Wehrell | A63B 23/047 |
| 2008/0300118 | A1 | 12/2008 | Wehrell | |
| 2010/0298104 | A1 | 11/2010 | Turner | |
| 2011/0003669 | A1 * | 1/2011 | Planke | A63B 21/00196 482/139 |
| 2013/0130866 | A1 | 5/2013 | Wehrell | |
| 2015/0126344 | A1 | 5/2015 | Wehrell | |
| 2015/0182775 | A1 * | 7/2015 | Toback | A63B 5/16 482/130 |

OTHER PUBLICATIONS

International Searching Authority, International Search Report for corresponding application PCT/US15/10071 dated Apr. 28, 2015, 1pg.
European Search Report for Application No. EP15733325 dated Aug. 4, 2017, 12 pages.

* cited by examiner

SYSTEMS AND METHODS FOR OVER SPEED TO RESISTIVE TRAINING

RELATED APPLICATIONS

This Application claims priority to U.S. Prov. Pat. App. No. 62/158,993, filed May 8, 2015, herein incorporated by reference in its entirety for all purposes. This Application incorporates by reference U.S. patent application Ser. No. 14/588,892 entitled "Elastic Resistance Training Apparatus and Methods," filed Oct. 22, 2015, in its entirety for all purposes.

FIELD OF THE DISCLOSURE

This disclosure is generally related to the field of resistive and assistive training techniques for improving athletic performance.

BACKGROUND

Various systems are designed to help athletes train by providing assistance which enables performance beyond their un-aided capabilities. Over speed training is theorized to have neurological benefits which improve power production at high speeds, enabling athletes to increase top end performance. For example, a runner may use an over speed system which pulls a runner, thereby enabling the runner to achieve speeds (over speeds) higher than those an unassisted top speed. These over speed systems, with the exception of the treadmill, use some type of tether, which may be elastic or non-elastic, attached to the runner which is used to pull in the direction in which the runner runs. For an elastic tether, one end is attached to the runner and the other end is attached to a fixed point or a moving object, such as another runner. When the other end is connected to another runner, the runners separate until the elastic band is taut and begin to run. As the lead runner outpaces the trailing runner, a force is exerted on the trailing runner which may assist pulling the runner into an over speed condition. The lead runner is subjected to a resistive force and is significantly slowed from a top speed condition. If the trailing runner begins to close on the lead runner such that the distance between the two is less than that required for the tether to be taught, the tether will begin to slack, sag, and lead to a tripping hazard while the runner is at speed. Additionally, there is much difficulty in controlling the separation distance between the runners, which in turn affects the force applied to both. The unpredictable varying of the forces on the runners disrupts the runner's balance which is already difficult to maintain at over speed conditions.

If the other end of the tether is anchored to a fixed point, a once-taut band will again become slack, sag, and fall to the ground in front of the runner as the runner approaches the fixed point leading to another tripping hazard and limiting the distance that the over speed condition can be maintained.

Ground-based over speed systems typically use a non-elastic cord in which one end is attached to the runner and the other end is drawn into an apparatus either by a spring loaded mechanism or through the use of electric motors. Either mechanism or motor supplies the force which aid the runner in achieving an over speed condition. However, these systems require the athlete to slow down rapidly such that they do not run into the apparatus toward which they are pulled. Additionally, these systems require a runner to return to the starting point in order to conduct any subsequent runs.

The above described methods do not allow for the precise control of assisting forces to aid in an over speed condition. Additionally, these systems provide tripping hazards, require the runner to slow down to prevent a collision with the system, limit the distance of the over speed runs, and require significant breaks in training as a runner resets for subsequent runs.

Additionally, none of the above described systems allow for the application of a resistive force to the runner when the runner is in an over speed condition.

There is a need for systems and methods which provide assistance in reaching over speed conditions and can apply resistive opposition to the runner during the over speed condition. Further, there is a need for systems and methods which aid in achieving over speed conditions without providing tripping hazards due to slacking tethers at any point during the training event. There is a need for better control of the force applied to the runner than the control achievable by using two runners tied together. There is a need to provide systems and methods which do not require the runner to brake or slow quickly to avoid a collision with a training apparatus. There is a need for systems and methods which allow the runner to rapidly conduct successive training runs without having to reset.

The present disclosure provides systems and methods which address the foregoing limitations. Disclosed herein is an apparatus and methods capable of providing a resistance to a runner in two directions: one aiding and the other restricting the forward progress of the athlete along a linger path, thereby increasing the maximum achievable, unaided speed. The apparatus may apply a force pulling the athlete toward the apparatus thereby allowing the athlete to reach on over speed condition. When the athlete reaches the apparatus, a zero net force is applied to the athlete. As the athlete passes by or through the apparatus, the force is reversed from that originally applied, thereby imparting a resisting force to the athlete while the athlete is in an over speed condition. Applying this force in an over speed condition overloads the athlete's muscle and promotes muscles strength and high velocity power output. Additionally, the athlete will experience neurological benefits for achieve high speed conditions for greater times and distance than would be available otherwise.

As the athlete continues to move, a resisting force will continue to be applied and the athlete will slow down until stopping at the end of the resisting-portion of the movement. At the end of the resisting portion of the training, the athlete may immediately turn around and move toward the apparatus with a now assisting force which rapidly speeds the athlete back to an over speed condition. This cycle of assisting force, zero force, resisting force applied to the athlete can be done indefinitely without needing to reset the athlete after each movement.

In accordance with some embodiments of the present disclosure, a method for providing a training force to a trainee training in a selected mode of self-locomotion along a linear training path is provided. The method may comprise applying an assistive training force to the trainee which assists the self locomotion of the trainee along the training path a distance sufficient for the trainee to achieve an over speed condition in the selected mode of self-locomotion. The method may further comprise applying a resistive training force to the trainee which resists the self-locomotion to the training along the training path, the resistive training force being applied to the trainee while the trainer is in an over speed condition. The forces, either resistive or assistive, may vary linearly. The distances over which a assistive and resistive forces may be applied may be equal to one another or they may be unequal. The mode of self-locomotion may be running.

In accordance with some embodiments of the present disclosure, a method for the dynamic transitioning from over speed training to resistive training of a trainee moving along a linear training path in a selected mode of self-locomotion is provided. The method may comprise providing a linear training path and a transition gateway (or corridor) along the training path. The method may further comprise applying an assistive training vector to the trainee from each of a pair of modules laterally spaced from the training path. The assistive training vector assists in the self locomotion of the trainee as the trainee moves toward the transition gateway along the training path and leads to an over speed condition in the trainee for the selected mode of self-locomotion. The method may further comprise transitioning from the assistive training vector o a resistive training vector while the trainee is in an over speed condition. The method may further comprise applying the restrictive training vector to the trainee from each module which resisted the self-locomotion of the trainee as the trainee moves away from the transition gateway along the training path. The training vectors may be constant or vary linearly along the training path.

In accordance with some embodiments of the present disclosure, a training system is provided. The training system comprises a pair of modules, each module comprising a frame carrying a plurality of pulleys and a resistance cord. Each of the modules is adapted to provide a training vector to a trainee and is positioned on opposite side of training path to form a transition gateway so that the trainee may pass between the modules when moving along the path in a selected mode of self locomotion. The resistance cord passes through an anchor and is directed through the pulleys to a free end adapted for attachment to a trainee. The length of the resistance cord between the anchor and the free end is sufficient to provide a substantially linearly varying force to assist the trainee during the self locomotion toward the transition gateway along the training path at a distance sufficient from the trainee to pass through said transition gateway in an over speed condition and to provide the substantially linearly varying force to the trainee while in an over speed condition to resist the trainee during self-locomotion while moving away from the transition gateway. The system may further comprise a harness worn by the trainee which is adapted for connection to the free end of each of said resistance cords.

These and many other advantages of the present subject matter will be readily apparent to one skilled in the art to which the disclosure pertains from a perusal of the claims, the appended drawings, and the following detail description of the embodiments.

DETAILED DESCRIPTION

The objectives and advantages of the claimed subject matter will become apparent from the following detailed description of preferred embodiments thereof in connection with the accompanying drawings. While some embodiments and figures may reference running, a person of ordinary skill in the art will recognize that the embodiments herein are not so limited, and that the disclosure herein may be applied to many different forms of self locomotion.

Figure 1:
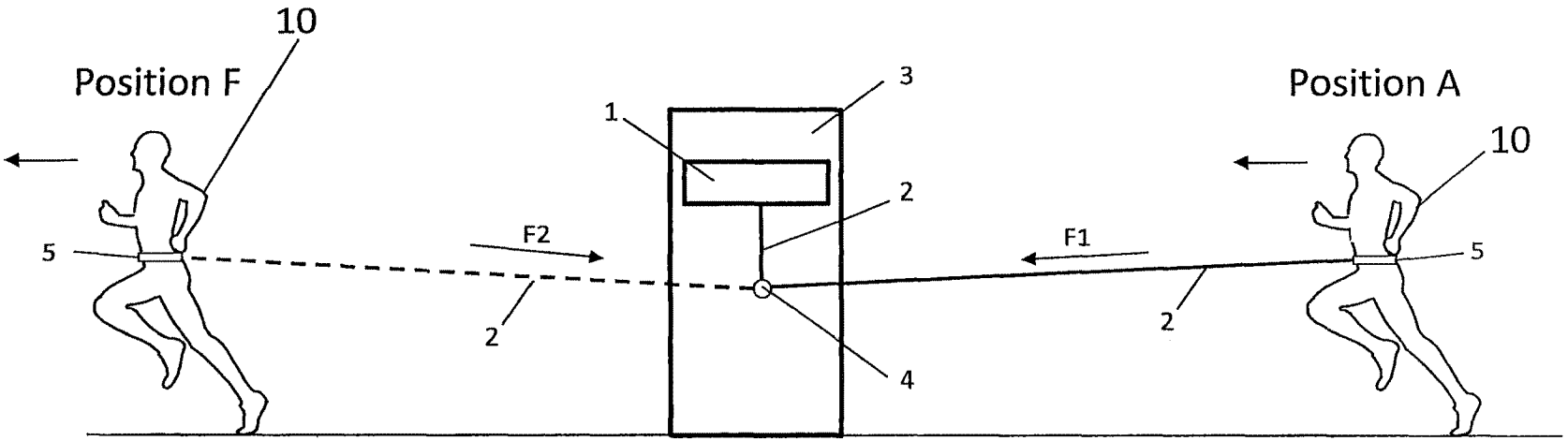
FIG. 1 shows an side elevation view of a training system in accordance with some embodiments of the present disclosure.
Figure 2:
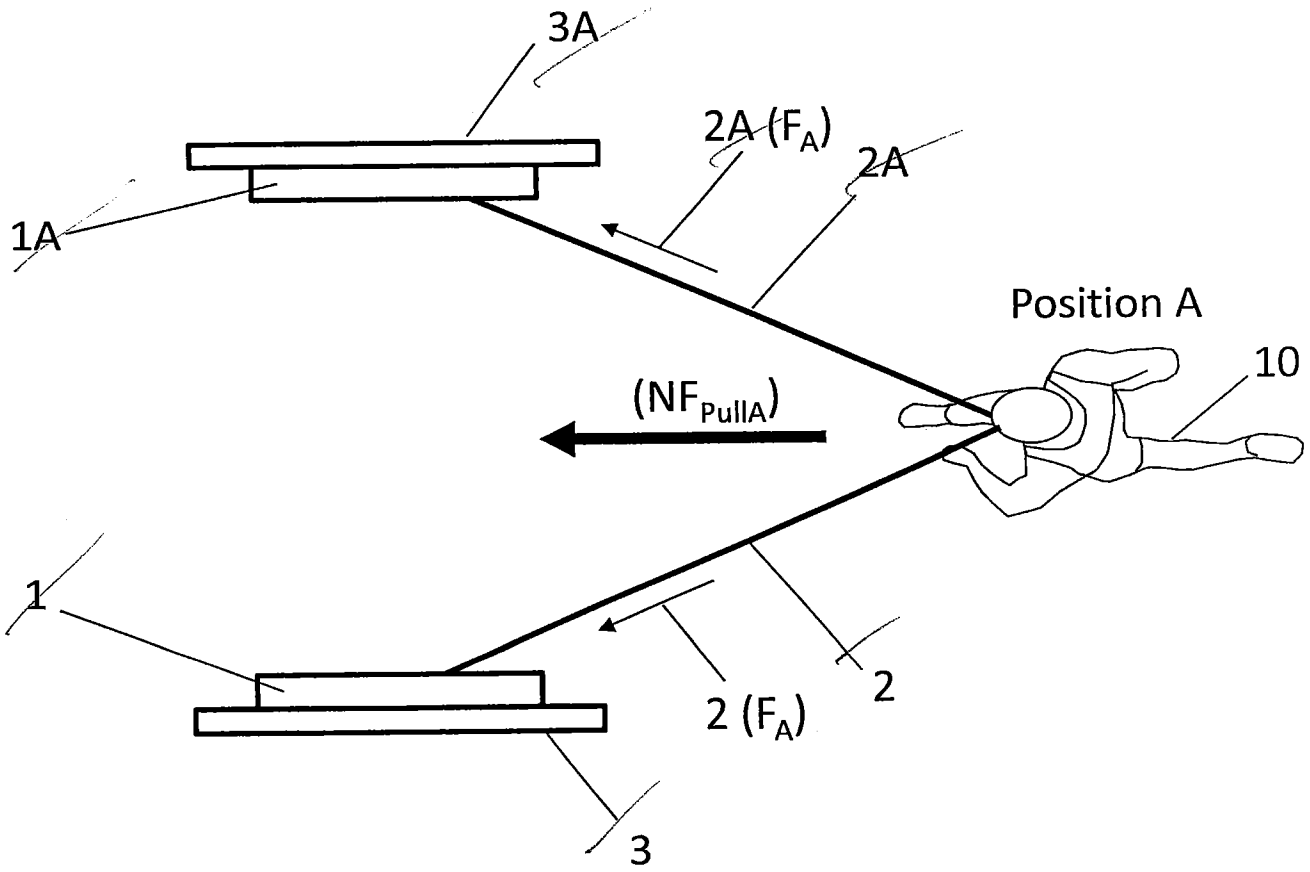
FIG. 2 shows a top-down view of a training system in accordance with some embodiments of the present disclosure.
Figure 3:
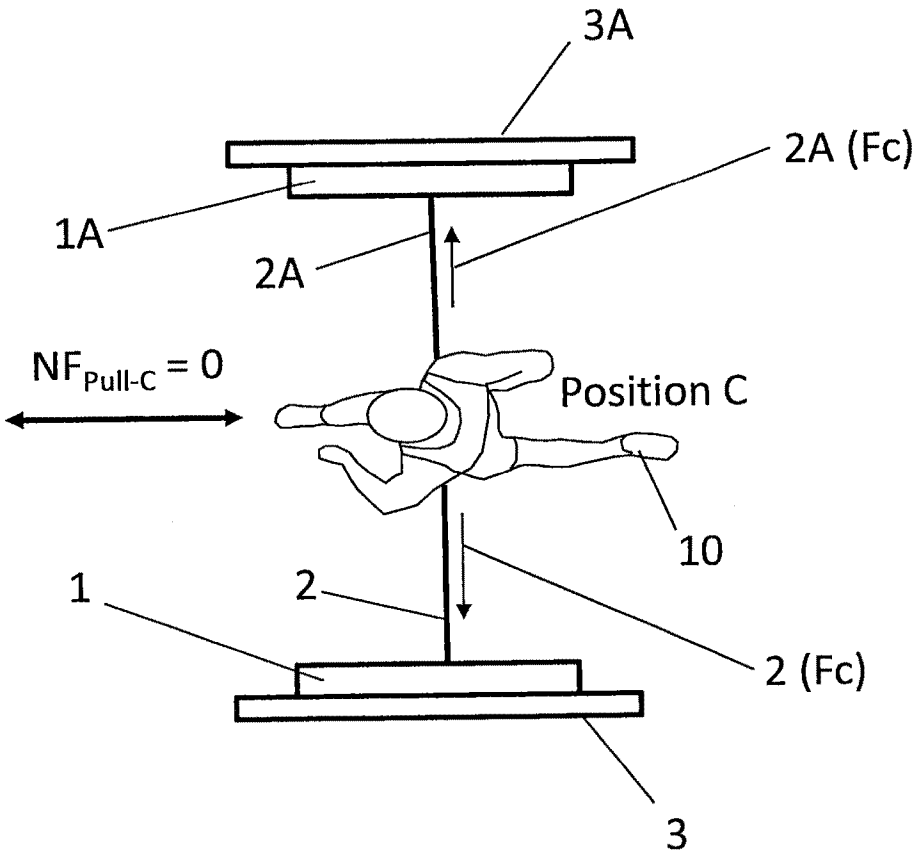
FIG. 3 shows another top-down view of a training system in accordance with some embodiments of the present disclosure.

A training system in accordance with some embodiments of the present disclosure is illustrated in FIG. 1 and FIG. 2. FIG. 1 illustrates a side elevation view and FIG. 2 illustrates a top-down view of the training system. The training system comprises vertical support structures 3 and 3A to provide support to elastic resistance modules 1 and 1A, respectively, elastic resistance tethers 2, 2A (which may be referred to as a resistance cord), a harness 5 which may be attached to the waist of a trainee 10 and at least a pair of rotating pulleys 4, 4A. Structures 3, 3A, tethers 2, 2A may be generically referred to as modules and are spaced laterally from the training path. The structures/modules may be positioned on opposite side of the training path and form a transition gateway there between such that the trainee can pass there through in a selected mode of self locomotion. While the trainee 10 in the illustrated figures is running, a person of ordinary skill will recognize that other modes of self locomotion may be utilized.

The vertical support structures 3, 3A are fixed to the ground or other object. In some embodiments, the structures 3, 3A are fixed rigidly, while in other embodiments the structures may be rotatably fixed. The structures 3, 3A may also form a frame to which a plurality of pulleys are connected. These pulleys may include pulleys 4, 4A and form an origin for a training vector or force which is applied to an athlete.

The elastic resistance modules 1, 1A may be those described in U.S. patent application Ser. No. 14/588,892, incorporated herein by reference. Resistance modules 1 and 1A may be located on support structures 3 and 3A in any orientation. Resistance module 1 may also be transferred to support structure 3A and attached in combination with resistance module 1A on the same vertical support structure if desired. The support structures for resistance modules 1 and 1A may also be horizontally oriented in nature or skewed at any angle between vertical and horizontal planes. The support structures may also pivot or rotate 360 degrees relative to the ground so that the module (the support structures 3 and module 1 and pulley 4) may track trainee movement as the trainee 10 runs in a 360 degree perimeter around the apparatus which may be anchored to the ground or even moveable utilizing on a base with wheels to which support structure 3 may be fixed.

The tethers 2, 2A are attached at one end (also referred to as a free end) to the harness 5, pass through and are routed by the routing pulleys 4, 4A to the resistance modules 1, 1A, respectively. While two tethers are shown, it will be understood that one or more tethers may be utilized. The Resistance tethers 2 and 2A may be more than 25 feet long each when in the relaxed state, and routed internally on pulley systems contained within modules 1 and 1A respectively. In some embodiments, other lengths may be used. The distal ends of elastic tethers 2 and 2A, which are not attached to the harness 4, may exit modules 1 and 1A respectively through locking mechanisms such as cam cleats which allow the trainee to retract or extract distal ends of the elastic tethers and then lock the tethers in place. This feature allows the user to effectively change the length of the relaxed tether between the cam cleat and trainee thus providing the ability to alter the level or resistance applied to the trainee by the tethers at any fixed distance within the training range of the apparatus. By controlling the length of the tethers 2, 2A, particularly the length of the tethers routed within the resistance modules 1, 1A, the forces exerted on the athlete 10 during training may be constant and/or varying linearly with the distance of the trainee 10/free ends of the tethers 2 from the origin (or pulleys 4), 4A. The linear or constant force may occur on either side of the system and may be either assistive or resistive. In some embodiments, the training vector (or forces) may be able to vary linearly over at least one hundred and twenty yards. The force may vary linearly while transitioning from an assistive training force to a resistive training force.

The force/vectors imparted by the tethers 2, 2A may be varied by changing the length of the tethers. In some embodiments, two or more tethers may be used. The tethers can be from 30 to 100 or more feet long when routed on the internal pulley system of each resistance module 1. In other embodiments the length of the tethers may be shorter or longer. Some embodiments of the system may be placed in the middle of a football field and allow a trainee to work over the complete area of a NFL football field without the tether ever going slack in any portion of the field from end zone to end zone. In some embodiments, the combined assistive and resistive training forces are applied over a distance of at least 80 yards. In some embodiments, the combined assistive and resistive training forces are applied over a distance of at least 100 yards. In some embodiments, the combined assistive and resistive training forces are applied over a distance of at least 120 yards. In some embodiments, the combined assistive and resistive training forces are applied over a distance of at least 150 yards. In some embodiments, the assistive training force is applied over a distance of at least half of the total training distance. In some embodiments, the assistive training force is applied over a distance of less than half of the training distance. In some embodiments, the assistive training force is applied over a distance of less than a third of the training distance. In some embodiments, the length of the tethers is sufficient to provide a constant or linearly varying (with distance from the modules) force for 40 yards from the gateway.

In some embodiments, the tethers 2, 2A may be connected to an electric motor with controller which will wind-in the tethers at a controlled rate in order to provide the desired assistive or resistive force to the trainee 10.

FIG. 1 illustrates that the force exerted on the trainee 10 is always directed toward the training system. When in Position A, a force (or training vector) F1 is exerted on the trainee 10, assisting the trainee 10 in the selected mode of self locomotion toward the center of the figure. When in Position F, a force F2 is exerted on the trainee 10 which resists the trainees movement away from the center of the figure. As illustrated in FIG. 2, each tether 2, 2A exerts a force 2 ($F_A$) and 2A ($F_A$) (note that subscripts used here are used to denote the force at a given position, e.g., "A"). These forces are composed a linear forces in the direction of the trainee's movement and lateral forces to the sides of the trainee. Due to the arraignment of the modules, the lateral forces of 2 ($F_A$) and 2A ($F_A$) cancel or substantially cancel and result in the illustrated net force $NF_{PullA}$.

As a trainee 10 passes by or through the system the net force applied to assist propulsion and over-speed training will automatically reduce to zero and then reverse direction so as to oppose the trainee's forward progress after passing by the modules. This reversal of applied force serves will act as a natural braking system so that the athlete 10 can slow down with assistance from the resistance tethers 2 pulling against the athlete's forward motion and it allows the athlete, if desired, to continue moving against the resistance applied by the tethers to help develop high velocity strength and power. The trainee 10 does not have to worry about stopping at the end of the over-speed training run, they can continue to accelerate right past the system and achieve higher speeds knowing that they have a considerable distance after completing the over-speed run to decelerate with resisted braking assistance or resisted training opposing their direction of movement which will eventually stop their forward progress.

With reference to FIGS. 3 to 11, a top-down view of a training system is shown which demonstrates a method according to some embodiments of the present disclosure by illustrating various positions of the trainee 10. Referencing FIG. 3 the trainee 10 positions himself at Position C between Support structures 3 and 3A with resistance modules 1 and 1A attached respectively. Resistance tethers 2 and 2A are attached to harness 5 on the trainee 10 and then distal ends of resistance tethers 2 and 2A are extracted from modules 1 and 1A respectively until the desired tension (e.g., greater than 1 pound each) is applied to the trainee equally by tethers 2 and 2A. The net force $NF_{Pull\text{-}C}$ driving the trainee either forward or backward at Position C is zero due to each tether 2 and 2A pulling equally to the left and right perpendicular to the direction the trainee is facing.

Figure 4:
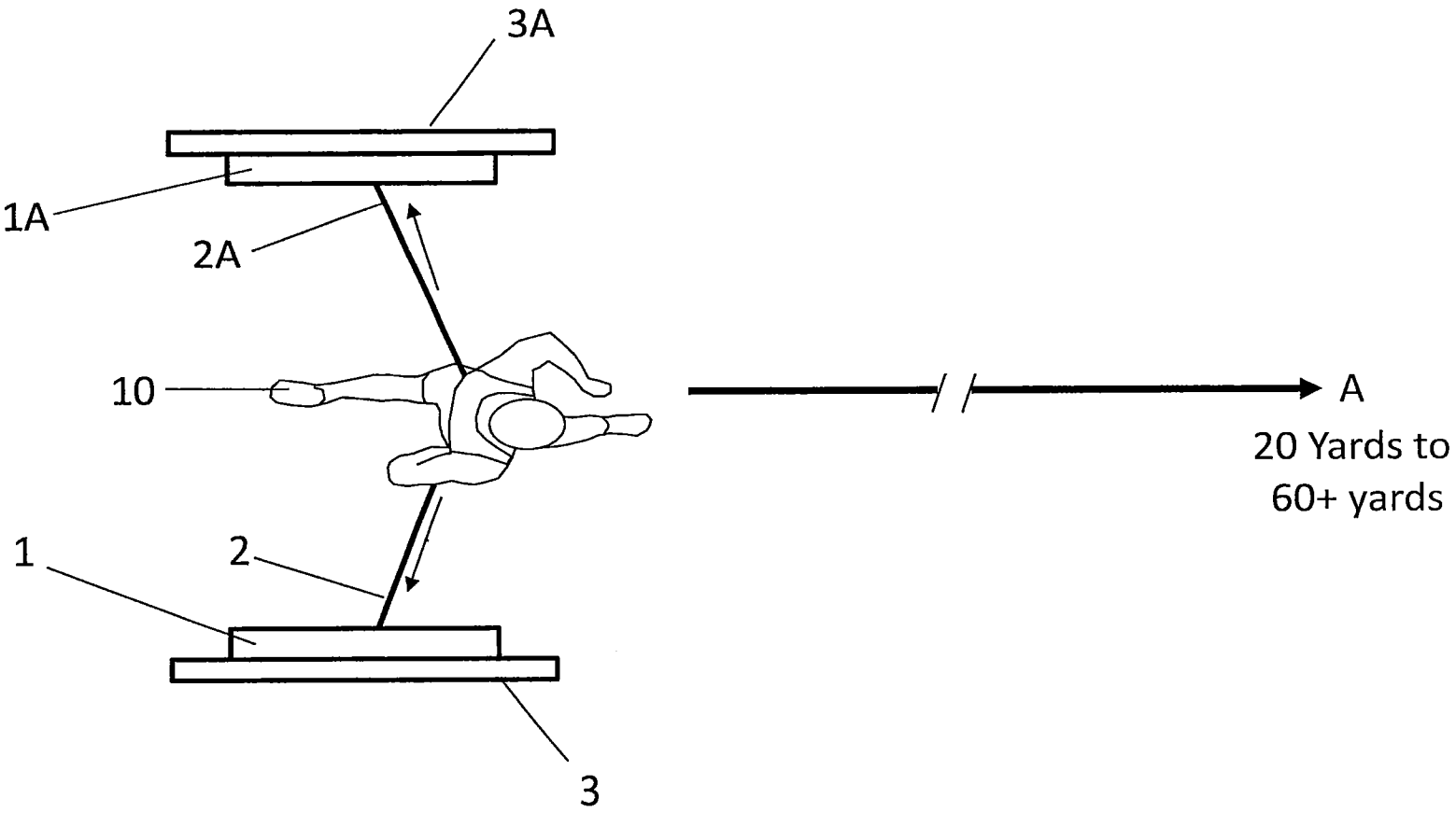
FIG. 4 shows another top-down view of a training system in accordance with some embodiments of the present disclosure.

After attaching the resistance tethers 2, 2A the trainee turns within the harness 5 and moves away from the apparatus some distance. In some embodiments this may be to a distance of 20 to 60 or longer yards to starting position A as shown in FIG. 4. The extended length of elastic cordage routed inside resistance modules 1 and 1A will allow the trainee to move considerable distances away from the apparatus so that the resistance set at Position C only increases by a factor, e.g., of 3 to 8 times at 60 yards. For instance 2 pounds set at Position C in FIG. 3 may increase to 8 pounds at a distance of 60 yards from the apparatus represented by starting Point A in FIG. 4.

Figure 5:
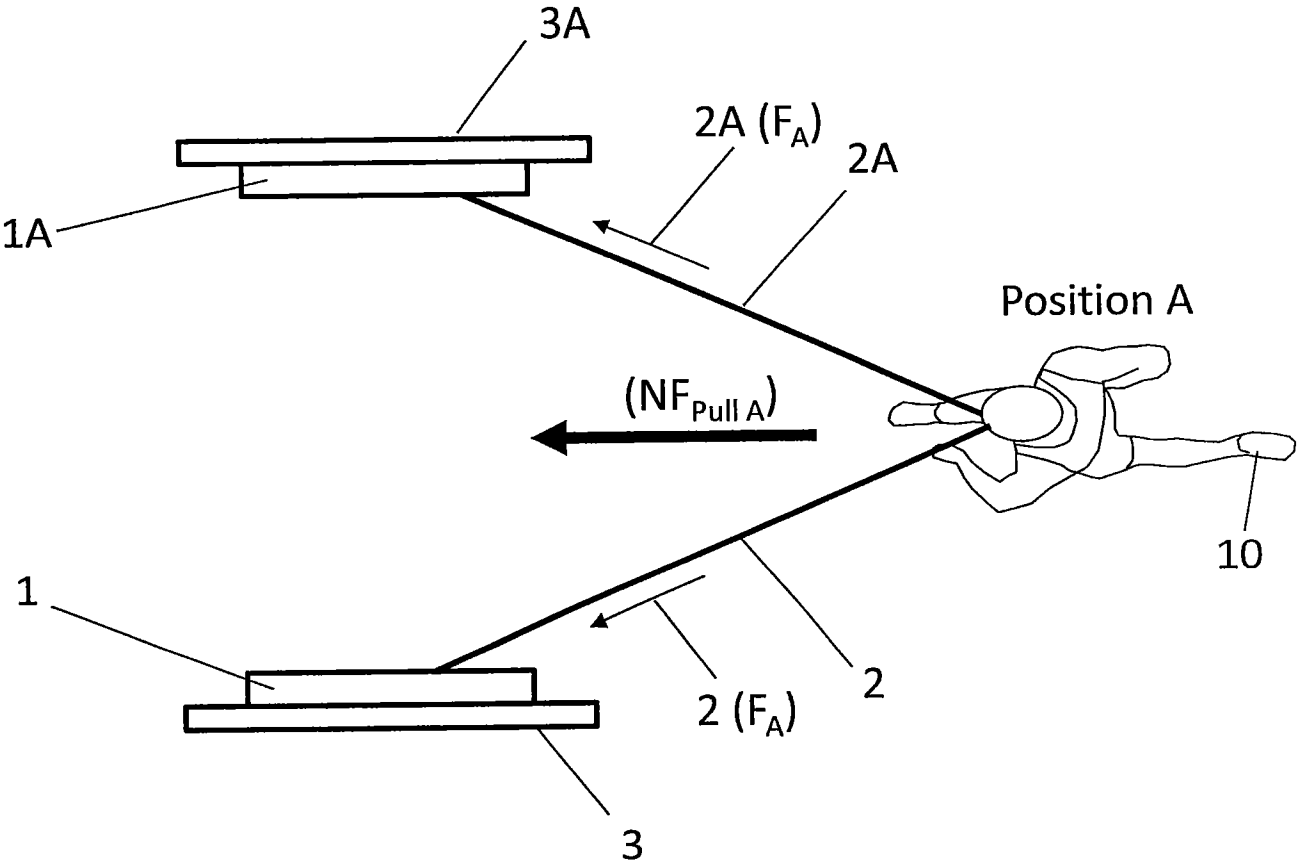
FIG. 5 shows another top-down view of a training system in accordance with some embodiments of the present disclosure.

Referencing FIG. 5, when the trainee 10 reaches starting Point A the trainee 10 turns 180 degrees within harness 5 and face the modules. Resistance tethers 2 and 2A apply a forces 2 ($F_A$) and 2A ($F_A$) respectively in the directions of the shown arrows to create a net force $NF_{Pull\ A}$ pulling the trainee 10 directly between the two support structures 3 and 3A. From Position A in FIG. 5 the trainee 10 begins to accelerate towards the apparatus with the aid of force $NF_{Pull\ A}$ which enables the Trainee to accelerate much faster compared to unaided acceleration.

Figure 6:
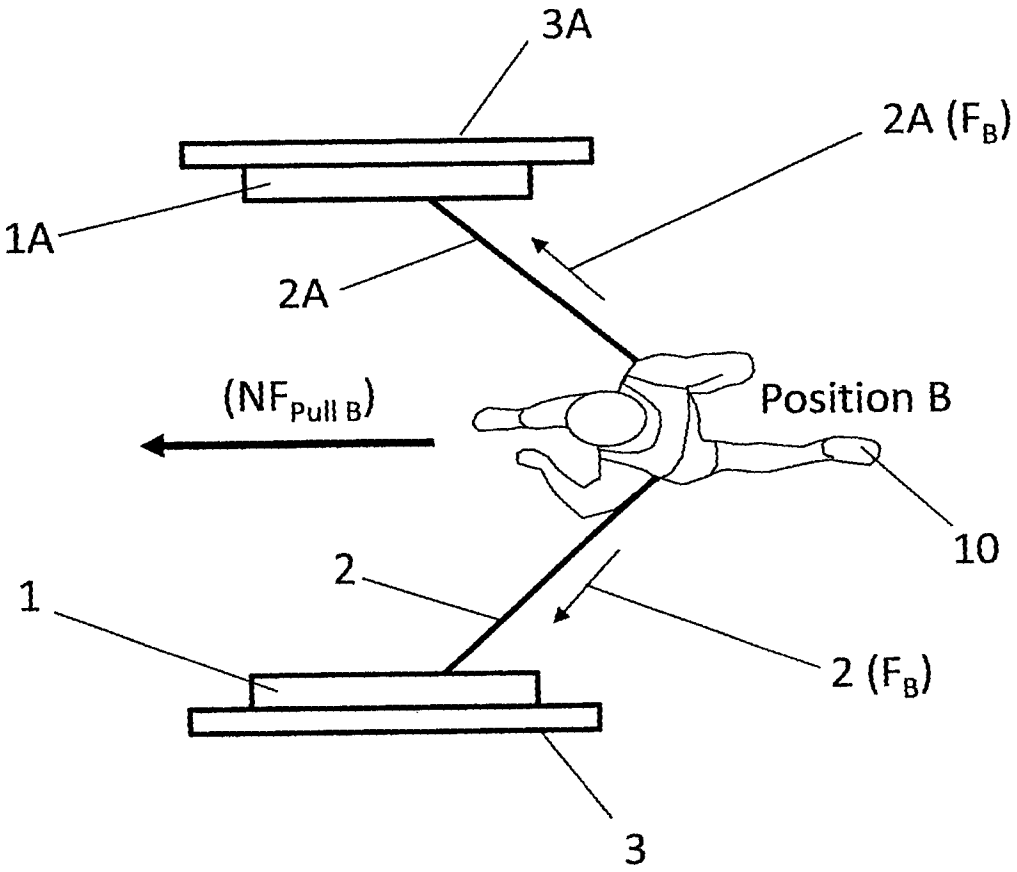
FIG. 6 shows another top-down view of a training system in accordance with some embodiments of the present disclosure.
Figure 7:
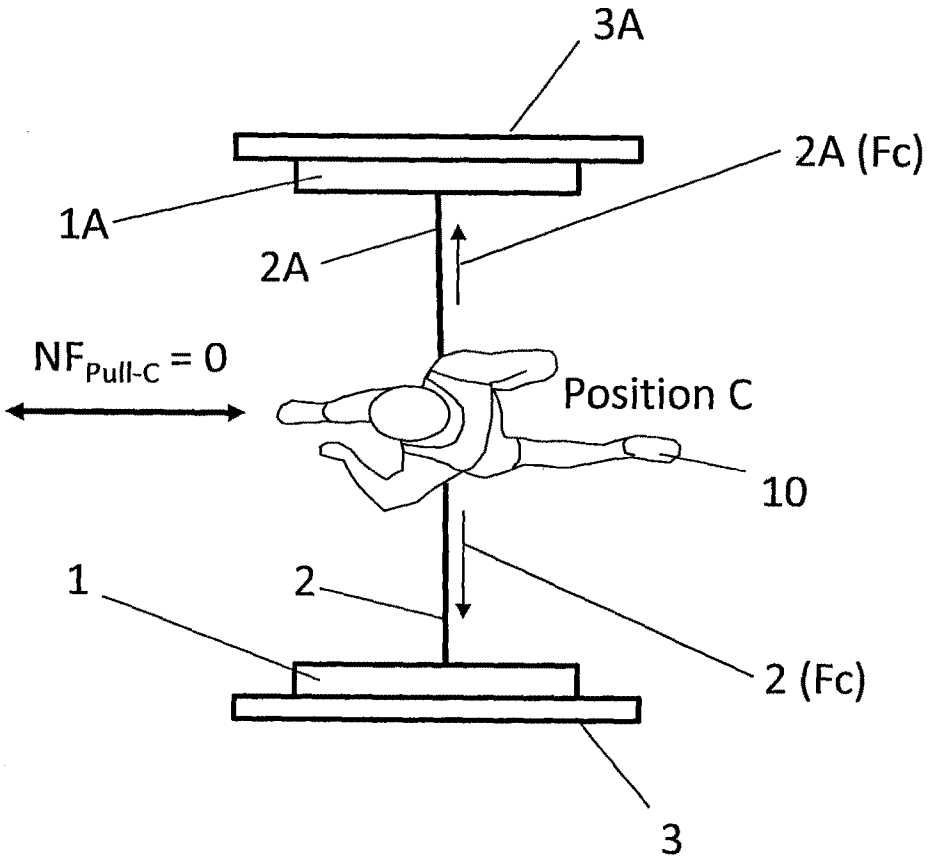
FIG. 7 shows another top-down view of a training system in accordance with some embodiments of the present disclosure.

Referencing FIG. 6, as the trainee 10 accelerates towards the apparatus and reaches Position B, representing a midpoint between starting Position A and Position C which lies between the apparatus support structures, both tethers 2 and 2A retract into resistance modules 1 and 1A. These tethers can retract faster than a human can move and thus maintain a net resistive force in the direction of the running trainee 10 which accelerates the trainee 10 even faster enabling the trainee 10 to achieve over speed training and run at velocities faster than otherwise possible with natural abilities alone. This faster retraction also allows resistive tethers 2 and 2A stay taught applying forces 2 ($F_B$) and 2A ($F_B$) (resulting in the net force $NF_{Pull\ B}$) in a direction which continues to provide a force accelerating the trainee 10. As the Trainee moves from Position A (FIG. 5) to Position B (FIG. 6) to Position C between the vertical support structures (FIG. 7) and past vertical support structures 3 and 3A, the resistance tethers 2 and 2A on to Position D (FIG. 8) and Position E (FIG. 9), connected to harness 5 which may have sliding attachments, automatically migrate from the front of the harness 5 (FIG. 5) to the rear of harness 5 (FIG. 9). The constant tension applied by tethers 2 and 2A allow the tether attachment points on harness 5 to easily slide from the front to the rear of the harness 5 as the trainee moves between the vertical support structures 3 and 3A and the force vectors (training vectors) switch from emanating in front of the trainee 10 to emanating in back of the trainee 10.

As the trainee 10 reaches Position C (FIG. 7) the net force $NF_{Pull\text{-}C}$ aiding or restricting the trainee's 10 forward progress is zero as resistance from tethers 2 and 2A are directly opposing each other and perpendicular to the trainee's running (or other self locomotion) path.

Figure 8:
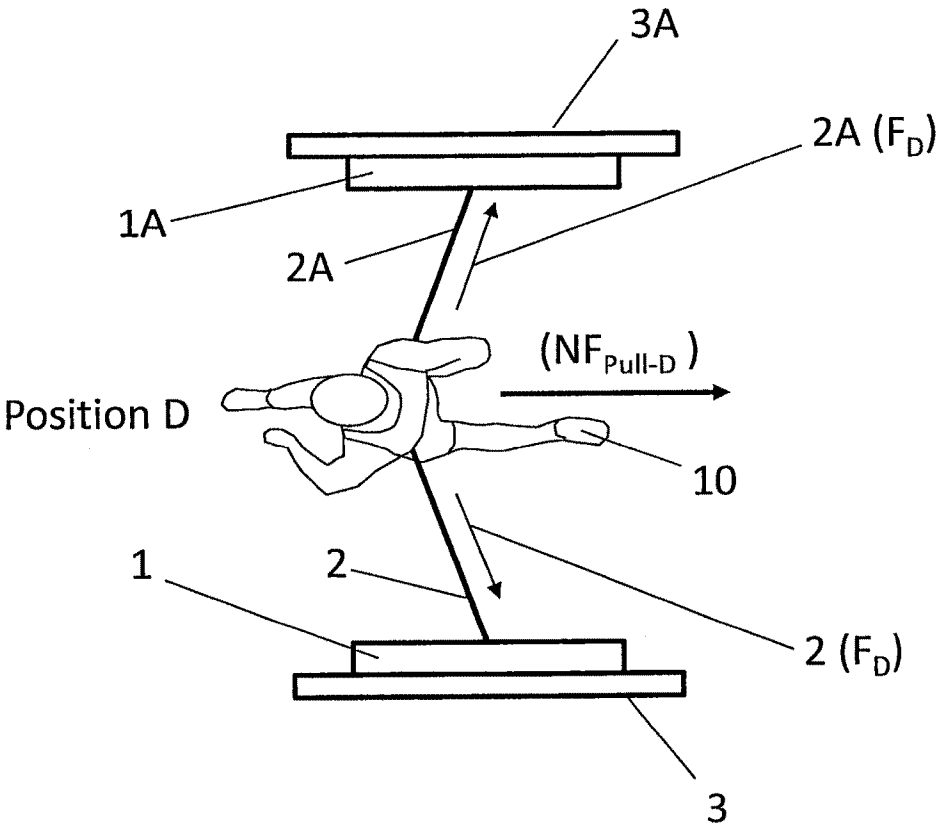
FIG. 8 shows another top-down view of a training system in accordance with some embodiments of the present disclosure.
Figure 9:
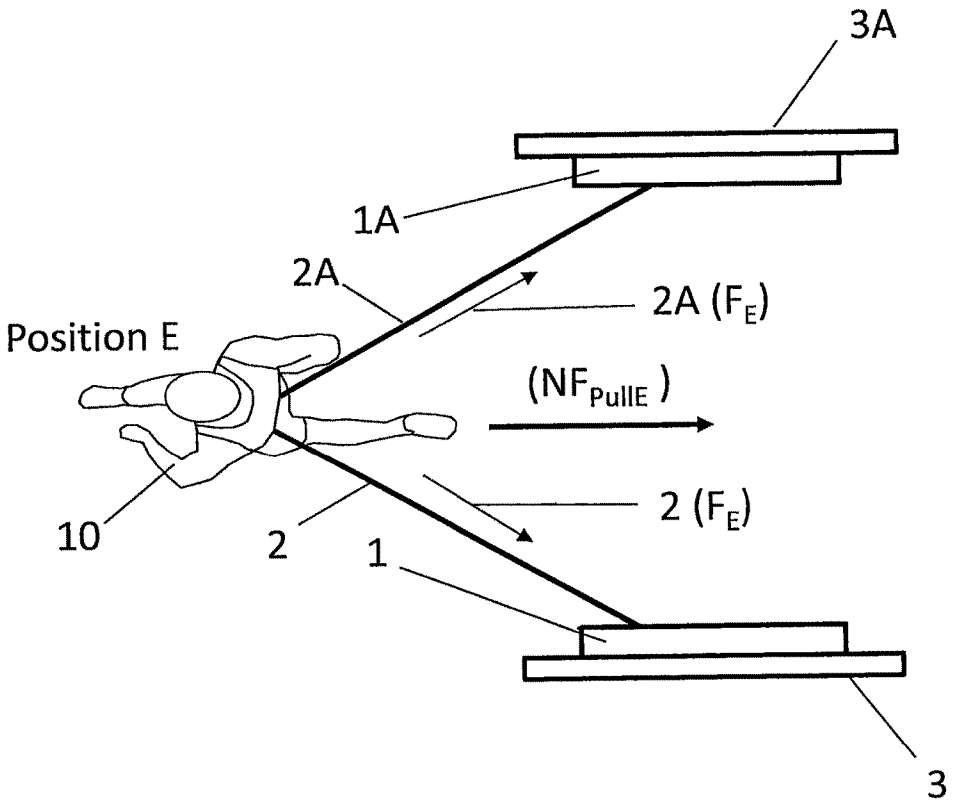
FIG. 9 shows another top-down view of a training system in accordance with some embodiments of the present disclosure.
Figure 10:
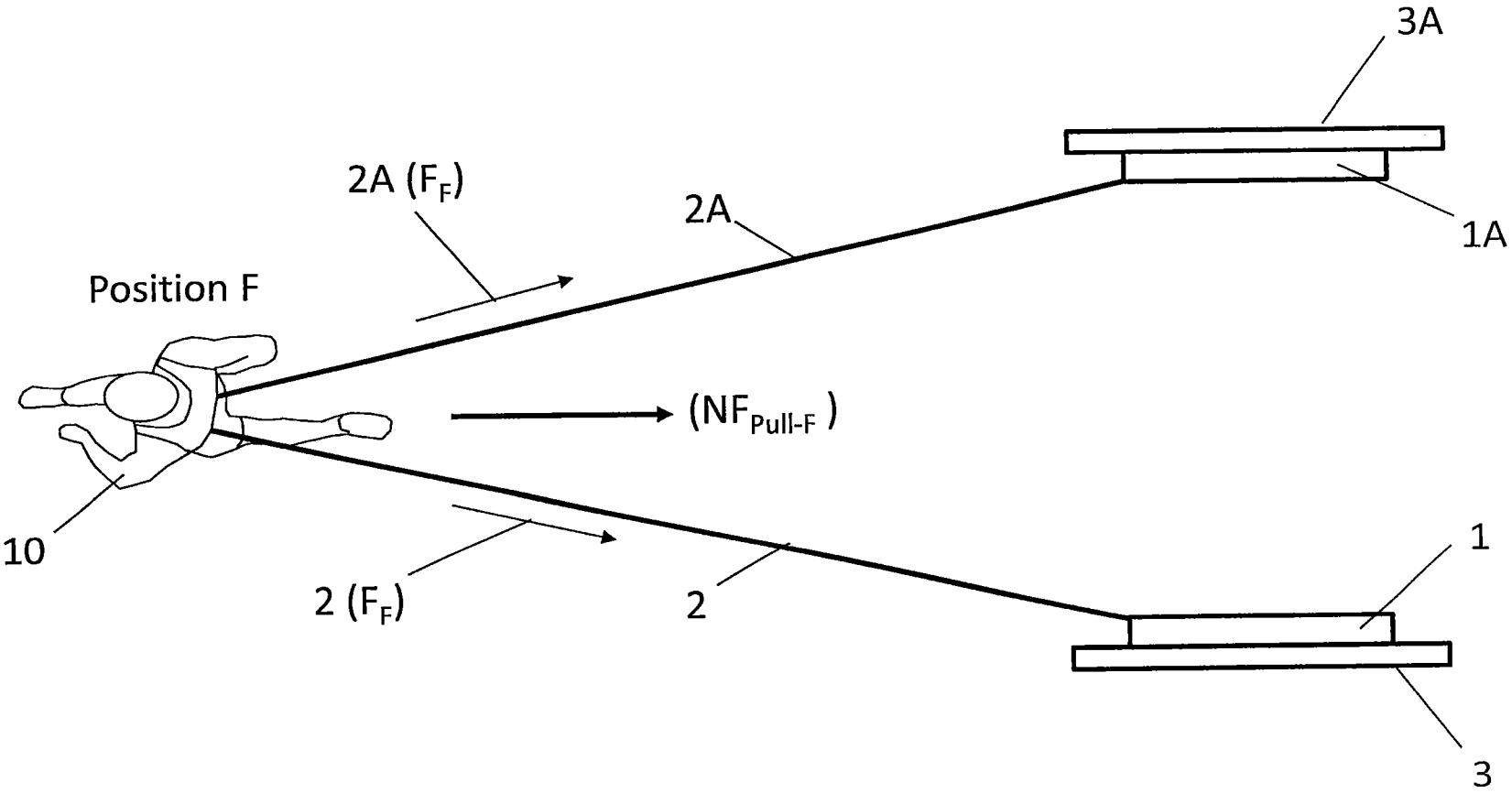
FIG. 10 shows another top-down view of a training system in accordance with some embodiments of the present disclosure.
Figure 11:
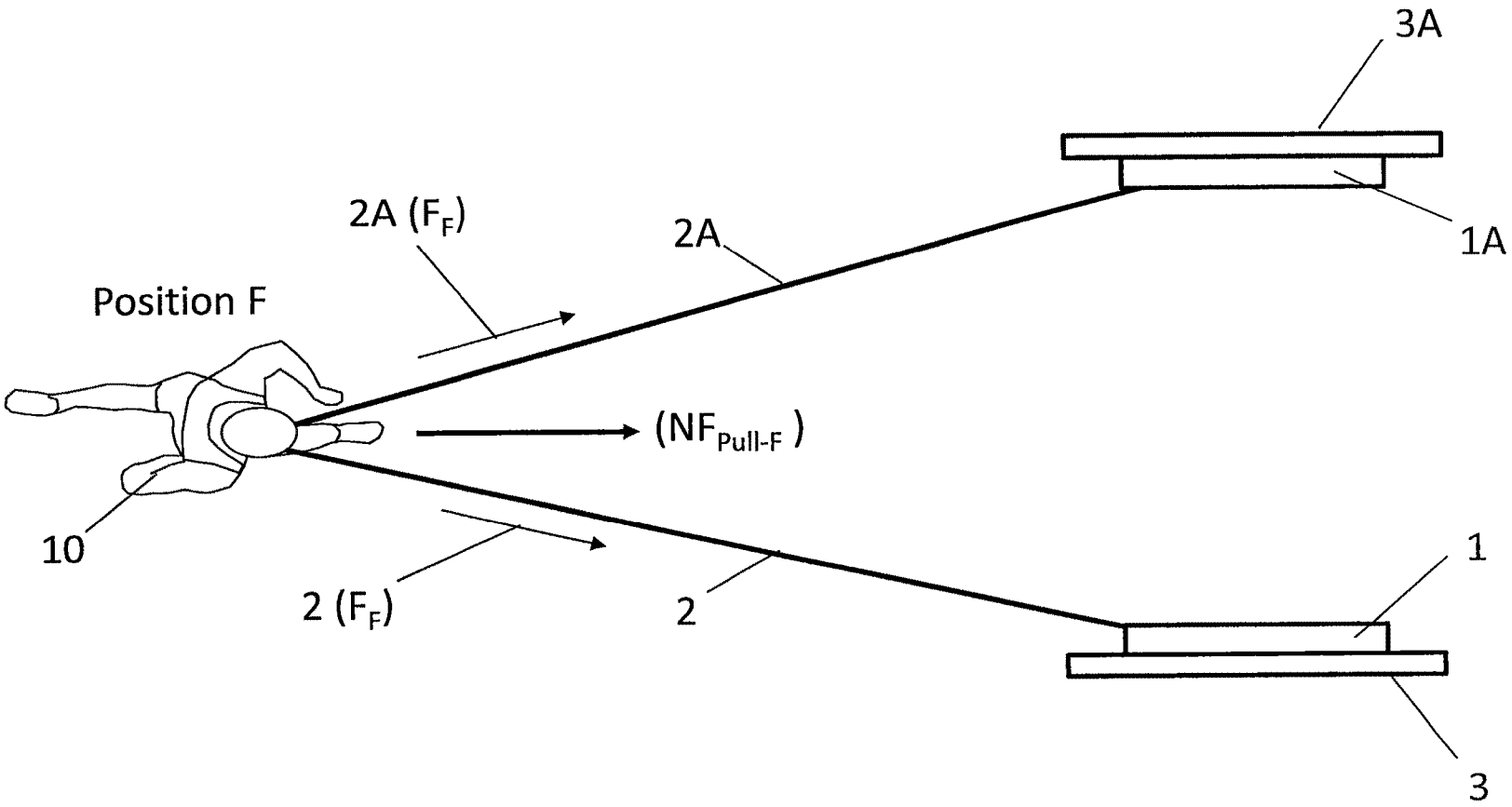
FIG. 11 shows another top-down view of a training system in accordance with some embodiments of the present disclosure.

Referencing FIG. 8, as the trainee 10 passes the emanation points of resistance tethers 2 and 2A from resistance modules 1 and 1A respectively, the force from both tethers 2 ($F_D$) and 2A ($F_D$) reverses direction creating a net force $NF_{Pull\text{-}D}$ opposing the Trainee's direction of motion and now the run has become a resisted run as opposed to an assisted over speed run.

As the trainee 10 progresses in the resisted run to Position E (FIG. 9) and Position F (FIG. 10), the resistance applied by tethers 2 and 2A will slowly increase as the trainee 10 approaches Position F which can be a similar distance from the apparatus as starting Position A whereby resistance levels applied by tethers 2 and 2A are approximately the same for equal distances on either side of the apparatus. Thus if Position A is approximately the same distance from the apparatus as Position F then the magnitude of $NF_{Pull\ A}$ will equal that of $NF_{Pull\text{-}F}$. As the trainee 10 runs against the applied resistance from tethers 2 and 2A from Position C to Position F (FIG. 10), the resistance will increase slowly to $NF_{Pull\text{-}F}$ and help decelerate the trainee at the end of the run from Position A to Position F.

While in some embodiments the distance over which a trainee 10 may move away from the module may be equal for both the assistive and resistive portions of the training movement, other embodiments are not so limited. For example, in one embodiment, the assistive portion of the evolution may be 40-50 yards and the resistive portion may be 20 to 100 yards from the module. In some embodiments the combined distances of the furthest extend of the resistive and assistive portions may be at least 30 yards.

Once the trainee 10 reaches the end of the training run at Position F (FIG. 10) they can simply turn 180 degrees around in the harness 5 (see FIG. 11) and repeat the over speed to resisted run in the opposite direction. The Trainee can repeat this process reversing direction at the end of each run indefinitely without having to adjust, reposition or reset any mechanical part of the apparatus.

Figure 12:
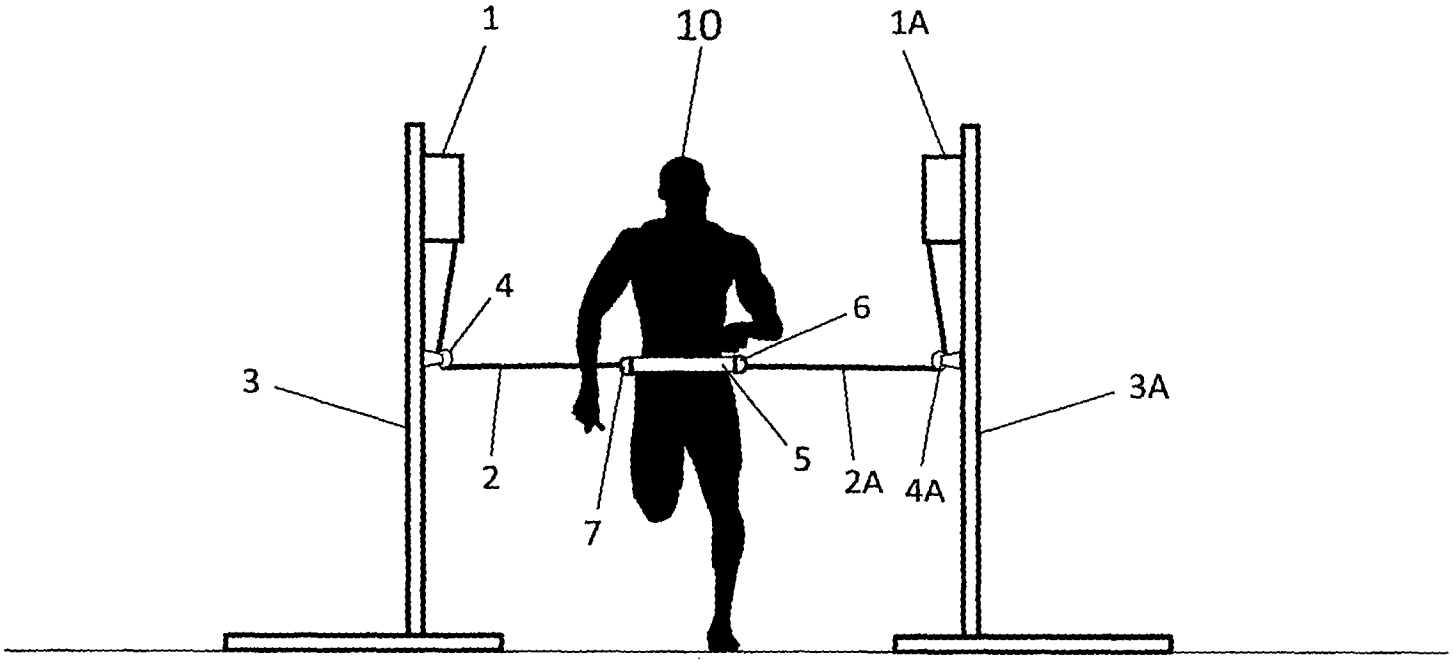
FIG. 12 shows a head-on, elevation view of a training system in accordance with some embodiments of the present disclosure.

FIG. 12 shows a head-on elevation drawing of the system illustrating harness 5 with sliding "D" rings or equivalent means 7 and 6 serving as attachment means for tethers 2 and 2A respectively. Sliding means 7 and 6 allow the resistance tethers to automatically move from the front to the rear of the trainee 10 as they pass through the apparatus. Routing assemblies 4 and 4A which direct the resistance tethers 2 and 2A from resistance modules 1 and 1A respectively to members 7 and 6, have attachment means to quickly position 4 and 4A in at many different elevations and horizontal positions on support structures 3 and 3A.

Figure 13:
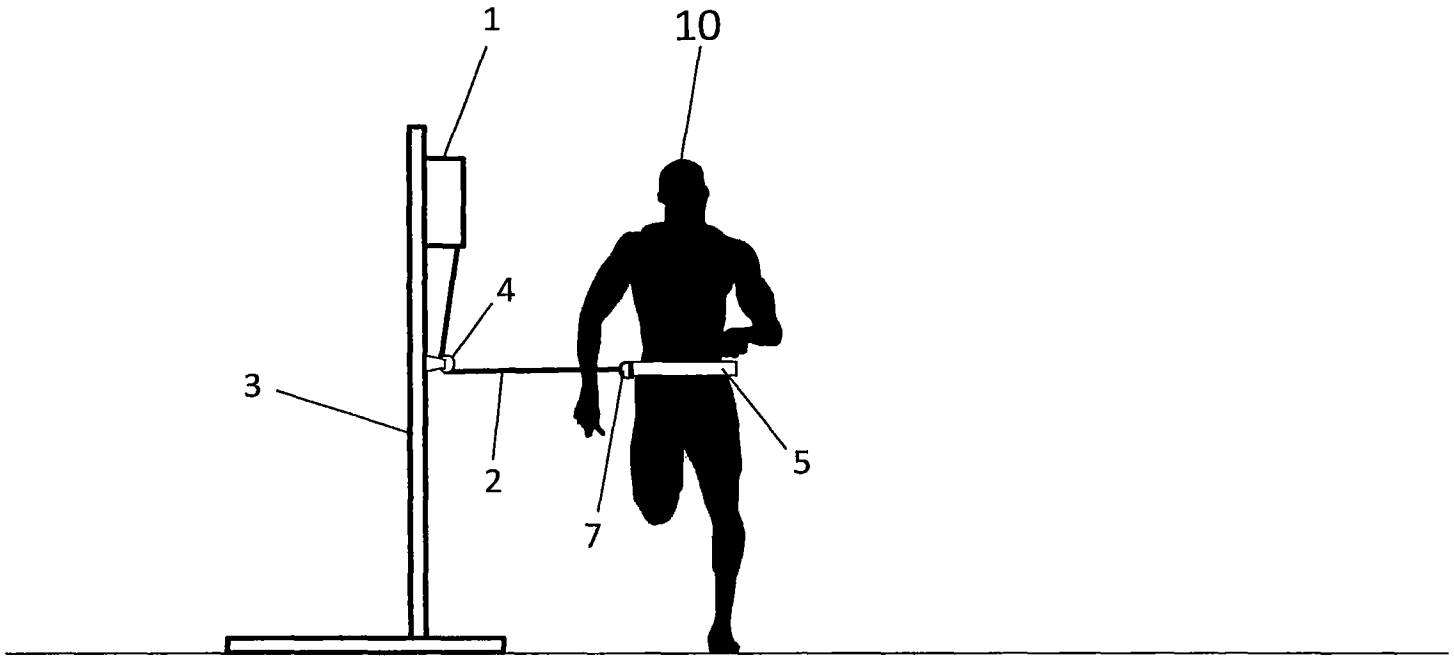
FIG. 13 shows another head-on, elevation view of a training system in accordance with some embodiments of the present disclosure.
Figure 14:
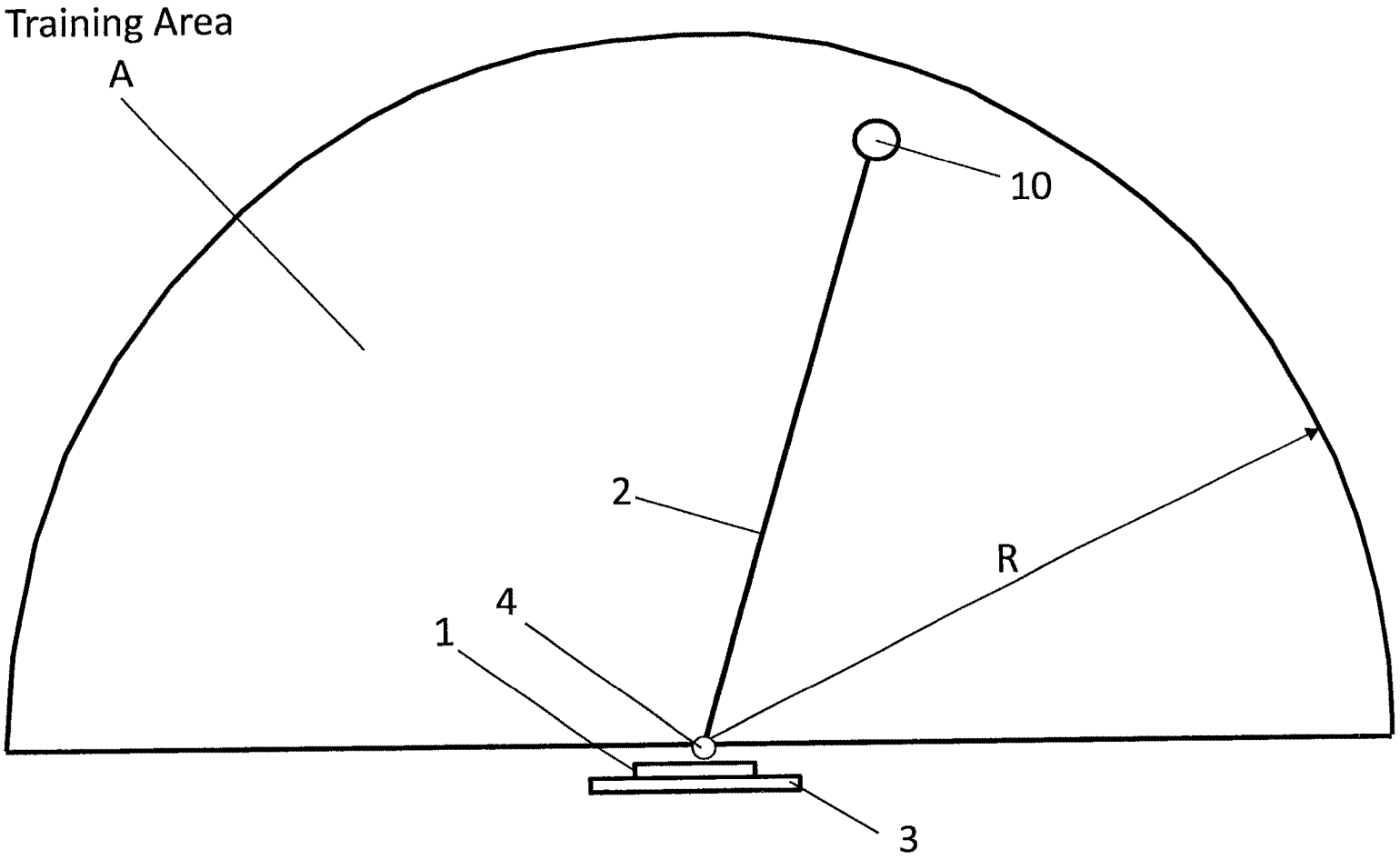
FIG. 14 shows another top-down view of a training system in accordance with some embodiments of the present disclosure.

In accordance with some embodiments of the present disclosure, a training system is provided. FIG. 13 illustrates an embodiment that utilizes only one vertical support structure 3 and a single resistance module 1 with resistance tether 2 routed through directing assembly 4 to harness 5 on trainee 10. FIG. 14 illustrates how the FIG. 13 embodiment will be able to apply a constant resistance to the trainee 10 as they run or walk about an area defined by a 180 arc (Training Area A) on one side of the support structure. In some embodiments, the outer bounds of the arc or radius R of the arc can range from one yard to over 60 yards from member 4. Thus trainee can run at any speed and direction within Training Area A and tether 2 will apply a nearly non-varying resistance whose resistance level change as a function of distance is small enough that the trainee will not noticeably feel changes in applied resistance with every step taken. It is also important to note that multiple resistance modules 1 with one or more elastic bands routed internally and output to the Trainee or multiple trainees may be used or attached on one or both sides of support structure.

Figure 15:
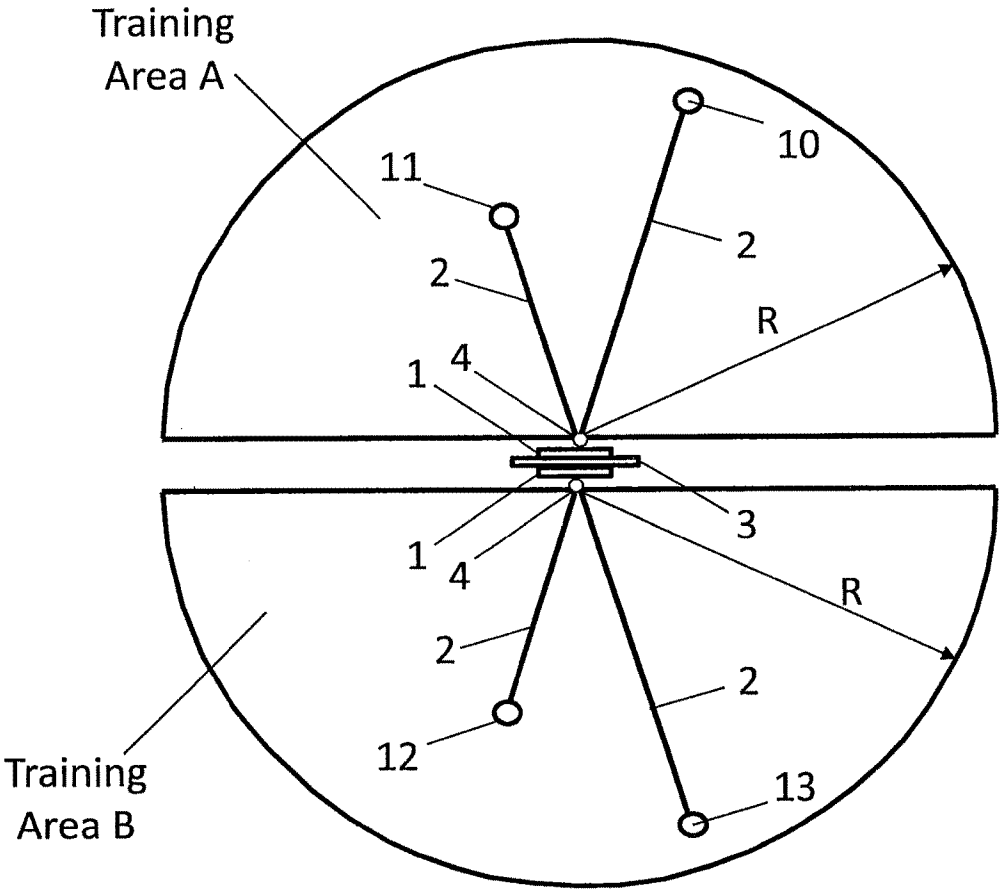
FIG. 15 shows another top-down view of a training system in accordance with some embodiments of the present disclosure.

FIG. 15 illustrates how multiple resistance tethers 2 from one or more resistance modules 1 on either side of structure 3 will allow multiple trainees 10 to exercise within an arc on each side of structure of radius R with such radius ranging from 1 yard to 60 or more yards. FIG. 15 illustrates a total of four Trainees 10, 11, 12 and 13 with two trainees in each of Training Area A and Training Area B.

Figure 16:
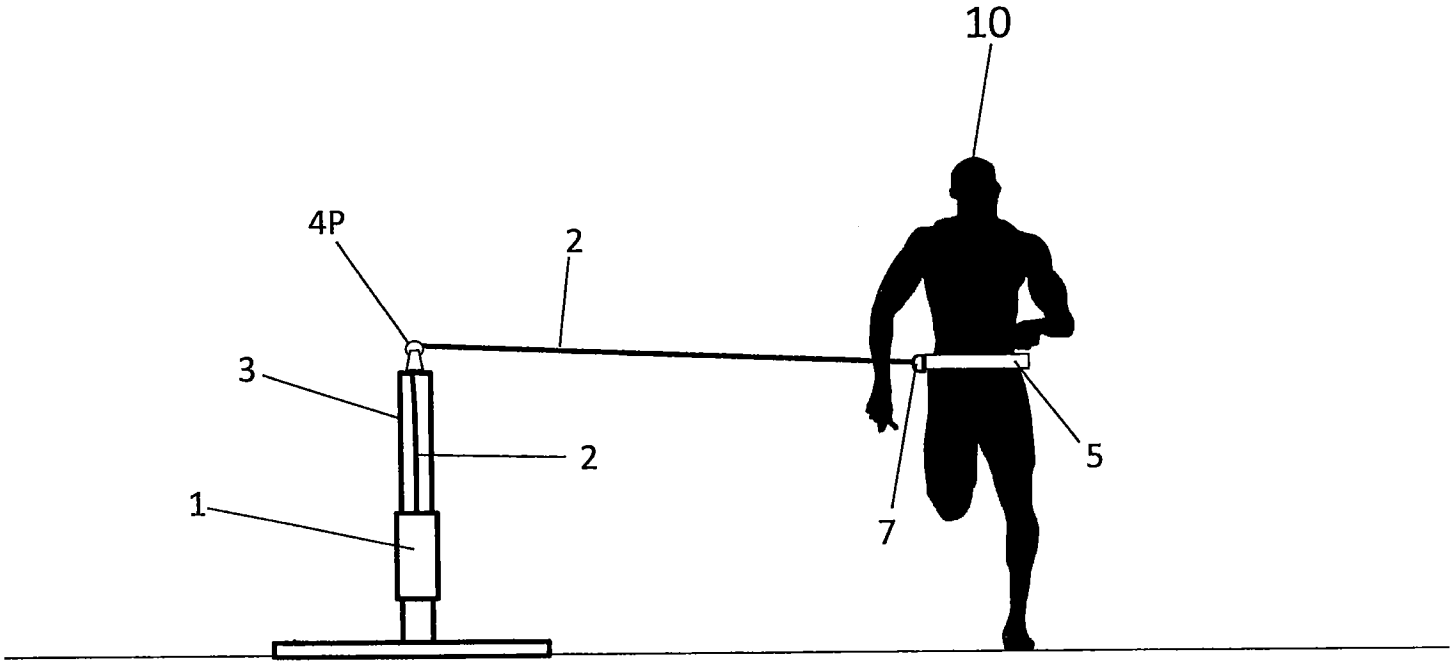
FIG. 16 shows another head-on, elevation view of a training system in accordance with some embodiments of the present disclosure.

In accordance with some embodiments of the present disclosure, a training system is provided in FIG. 16. FIG. 16 illustrates an embodiment that allows one or more trainees 10 to exercise in a 360 degree space surrounding the apparatus from a range of, in some embodiments, 1 yard to over 60 yards in either direction. In other embodiments, greater ranges may be used. Support structure 3 has routing assembly 4P with 360 degree pivoting abilities on vertical axis which will route resistance tether 2 to the Trainee's 10 harness 5.

Figure 17:
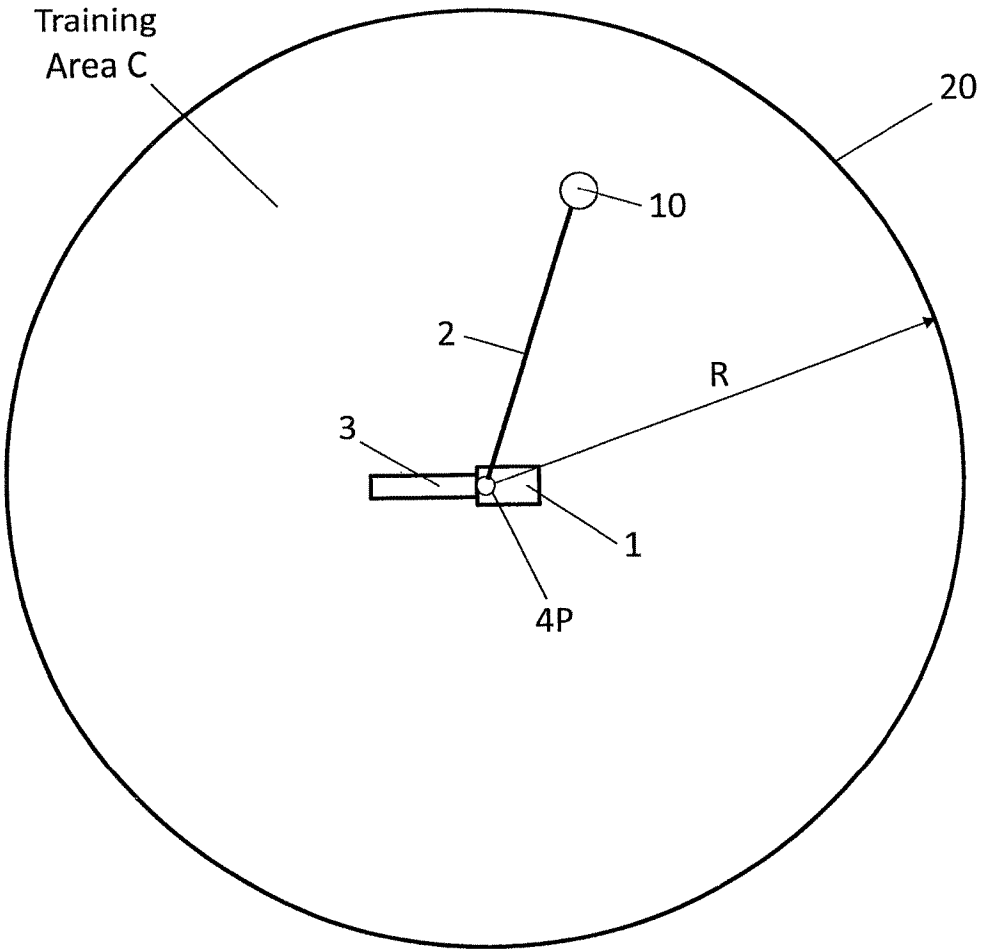
FIG. 17 shows another top-down view of a training system in accordance with some embodiments of the present disclosure.

Referencing FIG. 17, the embodiment described in FIG. 16 will allow one or more trainees 10 to run 360 degrees around the apparatus while pivoting assembly 4P allows resistance tether 2 to move 360 degrees around the apparatus while it is being extracted or retracted into the apparatus. Training Area C of radius R, represented by the 360 circle 20 defines the area Trainee 10 can exercise in running in any direction within the training area. Again additional resistance modules 1 with one or more resistance tethers 2 embedded to offer multiple resistance tethers 2 to athletes can be attached to structure 3 with additional 4P assemblies fixed to the top of structure 3 so that more than one resistance tether 2 can be routed to more than one trainee 10 so multiple trainees can train within the described training area with one or more resistance tethers attached each trainee.

The embodiments described herein will allow trainees while moving between two distal points to be both pulled in the direction they are moving so that they may move faster than their top unaided speed and during the same run to build muscular strength without stopping abruptly at the end of the run or having the trainee have to step over loose cordage once the resistance tether goes slack.

Trainees may conduct over-speed training with a net force pulling them in the direction they are moving for a portion of the run between two distal and then reverse the net force acting on the trainee 180 degrees in the opposite direction of the trainee's forward progress while at full speed. The system enables a force to be applied to the trainee slowing them down after performing over-speed training with resistance aiding forward progress. Trainees will be able to achieve higher over-speed training velocities because they can keep running after the conclusion of the over-speed training portion of the run with a resisting force applied for a considerable distance after over-speed training.

As described above, the embodiments of the present disclosure provide systems and methods which apply both a assistive and resistive training vectors to assist an athlete in reaching an over speed direction and then applying a resistive vector to the athlete in the over speed condition. The force, or training vector, will shift 180 degrees as the athlete passes by the training apparatus. The athlete may also experience an assistive force when moving toward the apparatus and a resistive force when moving away, regardless of whether the athlete's motion is linear or not. The system and apparatus provides a braking function to slow the athlete as the athlete moves away from the apparatus or system. The systems and methods disclosed herein provide for the rapid repetition of subsequent training evolutions wherein the athlete may merely turn around to being a successive training movement, regardless of whether the athlete has returned to a starting point, markedly improving the time efficiency of conducting repeated training evolutions and allowing for training to be conducted in multiple directions. The athlete need not slowdown in order to avoid colliding with the training apparatus. The tether's used to aid the athlete in achieving an over speed condition will not slack and become a tripping hazard.

While preferred embodiments of the present subject matter have been described, it is to be understood that the embodiments described are illustrative only and that the scope of the subject matter is to be defined solely by the appended claims when accorded a full range of equivalence, many variations and modifications naturally occurring to those of skill in the art from a perusal hereof.

I claim:

1. A method for dynamic transitioning from over speed training to resistive training of a trainee moving along a linear training path in a selected mode of self-locomotion, said method comprising:

providing a linear training path;

providing a transition gateway along the training path, the gateway comprising a pair of modules laterally spaced from and orthogonal to the training path, each of said modules being adapted to provide a training vector to the trainee;

applying an assistive training vector to the trainee from each module that assists self-locomotion of the trainee as the trainee moves toward the transition gateway along the training path, the assistive training vector being applied to the trainee to effect an over speed condition in the trainee for the selected mode of self-locomotion;

transitioning the assistive training vectors to resistive training vectors while the trainee is in the over speed condition; and applying the resistive training vector to the trainee from each module that resists self-locomotion of the trainee as the trainee moves away from the transition gateway along the training path.

2. The method of claim 1 wherein the magnitude of the training vectors are constant or vary linearly while assisting self-locomotion of the trainee.

3. The method of claim 2 wherein the magnitude of the training vectors are constant or vary linearly while resisting self-locomotion of the trainee.

4. The method of claim 1 wherein each module comprises a resistance cord being anchored proximate the module and being adapted for attachment at a free end to the trainee, the resistance cord having an effective length from the anchor to the free end sufficient to provide a training vector having a linearly varying magnitude over a training path extending at least forty yards from the gateway.

5. The method of claim 1 wherein each module comprises an electric motor and a tether, the tether being anchored at one end to the module and the other end being adapted for attachment to the trainee.

6. The method of claim 5 further comprising a motor controller programmable to provide a constant or varying training vector over the length of the training path.

7. The method of claim 1 wherein net training vector normal to the training path applied to the trainee is substantially zero.

8. A method for dynamic transitioning from over speed training to resistive training of a trainee moving along a linear training path in a selected mode of self-locomotion, said method comprising:

providing a linear training path;

providing a transition gateway along the training path, the gateway comprising a pair of modules laterally spaced from the training path, each of said modules being adapted to provide a training vector to the trainee;

applying an assistive training vector to the trainee from each module that assists self-locomotion of the trainee as the trainee moves toward the transition gateway along the training path, the assistive training vector being applied to the trainee to effect an over speed condition in the trainee for the selected mode of self-locomotion;

transitioning the assistive training vectors to resistive training vectors while the trainee is in the over speed condition;

applying the resistive training vector to the trainee from each module that resists self-locomotion of the trainee as the trainee moves away from the transition gateway along the training path; and wherein each module comprises a resistance cord being anchored proximate the module and being adapted for attachment at a free end to the trainee, the resistance cord having an effective length from the anchor to the free end sufficient to provide a training vector having a linearly varying magnitude over a training path extending at least forty yards from the gateway.

9. A method for dynamic transitioning from over speed training to resistive training of a trainee moving along a linear training path in a selected mode of self-locomotion, said method comprising:

providing a linear training path;

providing a transition gateway along the training path, the gateway comprising a pair of modules laterally spaced from the training path, each of said modules being adapted to provide a training vector to the trainee;

applying an assistive training vector to the trainee from each module that assists self-locomotion of the trainee as the trainee moves toward the transition gateway along the training path, the assistive training vector being applied to the trainee to effect an over speed condition in the trainee for the selected mode of self-locomotion;

transitioning the assistive training vectors to resistive training vectors while the trainee is in the over speed condition;

applying the resistive training vector to the trainee from each module that resists self-locomotion of the trainee as the trainee moves away from the transition gateway along the training path; and wherein each module comprises an electric motor and a tether, the tether being anchored at one end to the module and the other end being adapted for attachment to the trainee.

10. The method of claim 9 further comprising a motor controller programmable to provide a constant or varying training vector over the length of the training path.

11. A method for dynamic transitioning from over speed training to resistive training of a trainee moving along a linear training path in a selected mode of self-locomotion, said method comprising:

providing a linear training path;

providing a transition gateway along the training path, the gateway comprising a pair of modules laterally spaced from the training path, each of said modules being adapted to provide a training vector to the trainee;

applying an assistive training vector to the trainee from each module that assists self-locomotion of the trainee as the trainee moves toward the transition gateway along the training path, the assistive training vector being applied to the trainee to effect an over speed condition in the trainee for the selected mode of self-locomotion;

transitioning the assistive training vectors to resistive training vectors while the trainee is in the over speed condition;

applying the resistive training vector to the trainee from each module that resists self-locomotion of the trainee as the trainee moves away from the transition gateway along the training path; and wherein net training vector normal to the training path applied to the trainee is substantially zero.

* * * * *